United States Patent [19]

Raiteri

[11] 4,231,212

[45] Nov. 4, 1980

[54] VALVE BAG FEEDING METHOD AND MACHINE FOR POWDER MATERIAL PACKAGING APPARATUS

[75] Inventor: Angelo Raiteri, Turin, Italy

[73] Assignees: UNICEM-Unione Cementerie Marchino, Emiliane e di Augusta S.p.A., Casale Monferrato; Andrea Doria, Turin, both of Italy; part interest to each

[21] Appl. No.: 6,705

[22] Filed: Jan. 26, 1979

Related U.S. Application Data

[63] Continuation of Ser. No. 833,526, Sep. 15, 1977, abandoned.

[51] Int. Cl.[3] ..... B65B 43/26

[52] U.S. Cl. ..... 53/459; 53/571; 53/384; 141/68

[58] Field of Search ..... 53/459, 570, 571, 384; 141/68, 315

[56] References Cited

U.S. PATENT DOCUMENTS

| | | | |
|---|---|---|---|
| 3,287,879 | 11/1966 | Miller | 53/571 |
| 3,913,635 | 10/1975 | Seals | 141/315 X |
| 3,952,479 | 4/1976 | Achelpohl | 53/570 |

FOREIGN PATENT DOCUMENTS

| | | | |
|---|---|---|---|
| 2126643 | 12/1972 | Fed. Rep. of Germany | 141/315 |

*Primary Examiner*—Travis S. McGehee
*Attorney, Agent, or Firm*—Marvin Reich

[57] ABSTRACT

To place the bags on a filling spout, the bags are hurled one at a time with the valve flange through a shaping tube, which is distanced from the spout as to allow the filled bag to be removed from the spout without displacing the tube. The bag is hurled at high speed by at least one continuously moving belt engaging the bag body along the entire length of the tube, as to be placed on the spout substantially when the valve flange leaves the tube. This latter is formed of two symmetric parts, the distance between which is adjustable by means of double screws having two ends threaded in opposite directions and engaging corresponding holes of the two parts of the tube.

16 Claims, 9 Drawing Figures

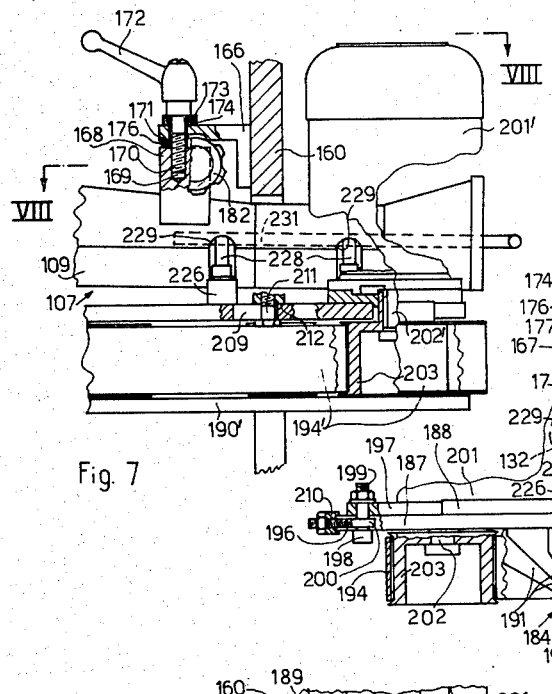
Fig. 7
Fig. 9
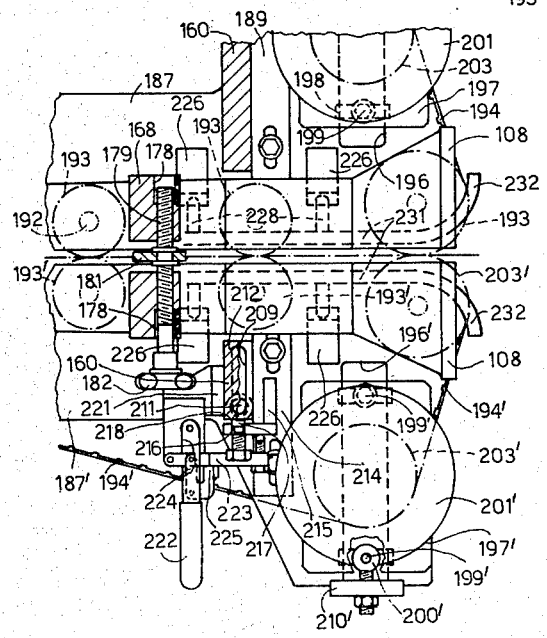
Fig. 8

VALVE BAG FEEDING METHOD AND MACHINE FOR POWDER MATERIAL PACKAGING APPARATUS

This is a continuation of Ser. No. 833,526, filed Sept. 15, 1977 abandoned.

BACKGROUND OF THE INVENTION

This invention relates to the apparatus for automatic packaging of powder material, as cement, flour, grain, fertilizer, insecticide, and the like. More particularly, the invention relates to a valve bag feeding method and machine for such packaging apparatus, wherein the bags are picked up one at a time from a magazine to be placed on a filling spout of a packaging apparatus.

Normally said materials are packaged in bags of paper or other material, which are provided on a pair of end edges with two flanges as bellows, wich are folded on one face of the bag. One of the flanges is provided with a valve, which closes automatically due to the pressure of the packaged material.

In a known bag feeding machine of the above type, the bag to be fed is picked up by grippers engaging the valve flange. The grippers rock the picked bag and carry it toward the spout upon causing the flange to cross a funnel for opening the valve. This machine has a disadvantage in that, the grippers are carried by a shaft which must rotate and translate through reciprocating movements, which require long dead times and produce a rather low speed movement of the bag. Furthermore, the funnel is located close to the spout, whereby after having guided the bag, the funnel must be removed to allow the bag to be filled.

The main object of the invention is to provide a bag feeding machine, which assures the introduction of the bag on the spout, without interfering with the filling operation.

SUMMARY OF THE INVENTION

According to this object, the bag feeding machine according to the invention comprises a shaping tube having a variable section and a substantially horizontal axis, said tube being adapted to be crossed by the valve flange of the bag and being provided with an axial notch directed downwards for the passage of the bag body, and is characterized in that said tube is distanced from said spout as to allow the bag to be filled and removed from the spout without displacing the tube, means being provided for hurling the bag at high speed so as to cause the valve flange to cross the tube for opening the valve and to assure its placing on the spout substantially when said valve flange leaves the tube.

BRIEF DESCRIPTION OF THE DRAWINGS

The following disclosure represents two preferred embodiments of the invention, made by way of example, but not in a limiting sense, in connection with the accompanying drawings, wherein:

FIG. 7 is a partial sectional, lateral view of the machine of FIG. 5, in an enlarged scale;

FIG. 8 is a partial sectional view taken along the line VIII—VIII of FIG. 7;

FIG. 9 is a partial sectional view taken along the line IX—IX of FIG. 5, in an enlarged scale.

DESCRIPTION OF THE PREFERRED EMBODIMENTS

Figure 1:
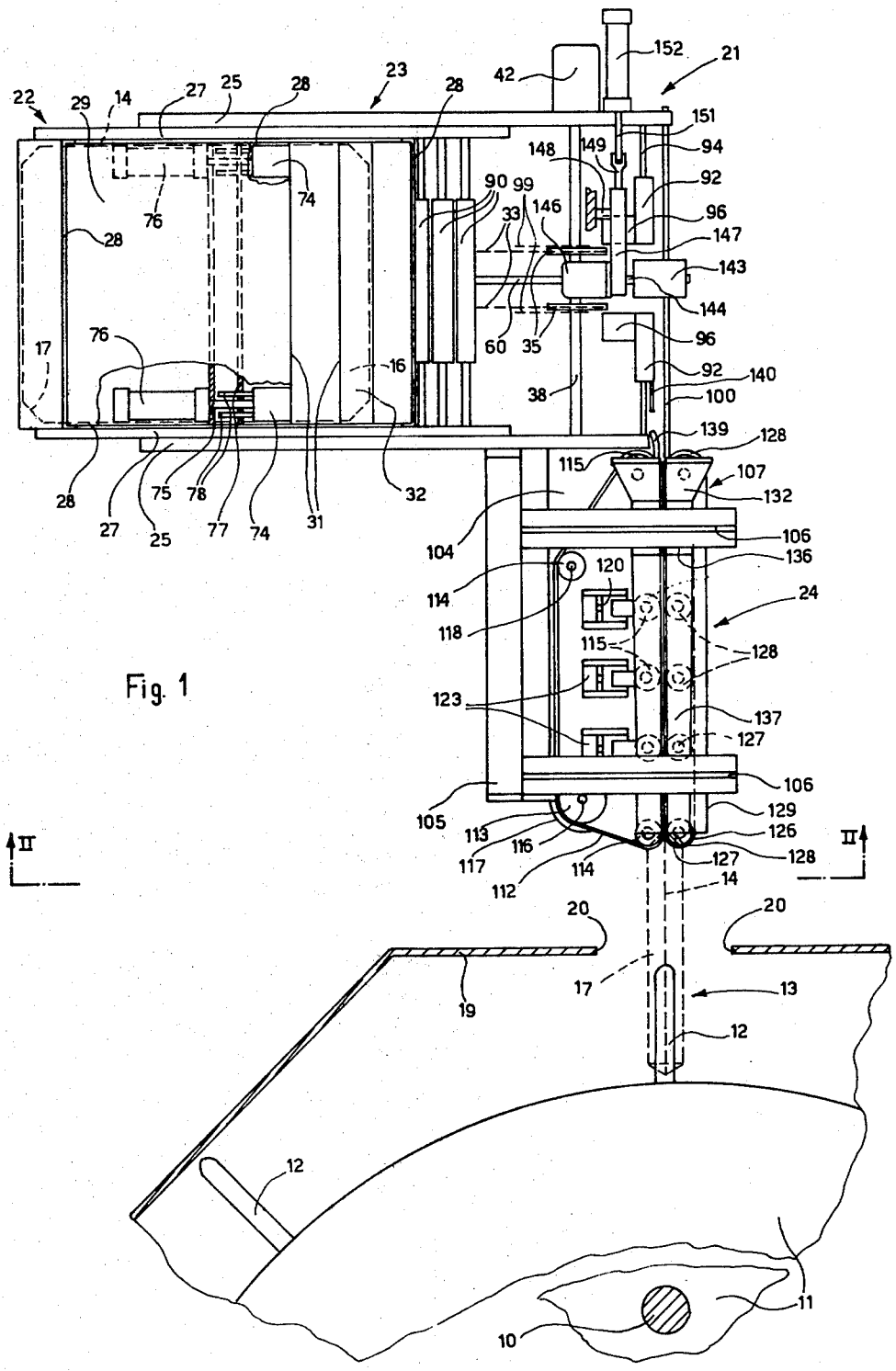
FIG. 1 is a general plan view of a powder material packaging apparatus, including a bag feeding machine according to a first embodiment of the invention.

With reference to FIG. 1, the numeral 11 generically indicates a rotatable structure of an apparatus for packaging powder materials, particularly cement. The structure 11 is provided with a plurality of spouts 12, adapted to connected one at a time with a cement supplying station, generically indicated by the numeral 13. To this end, the structure 11 is rocked step by step around a vertical shaft 10 to bring the spouts 12 sequentially on the station 13. Each spout 12 (FIG. 3) terminates with an opening directed downwards for the exit of the cement.

Figure 3:
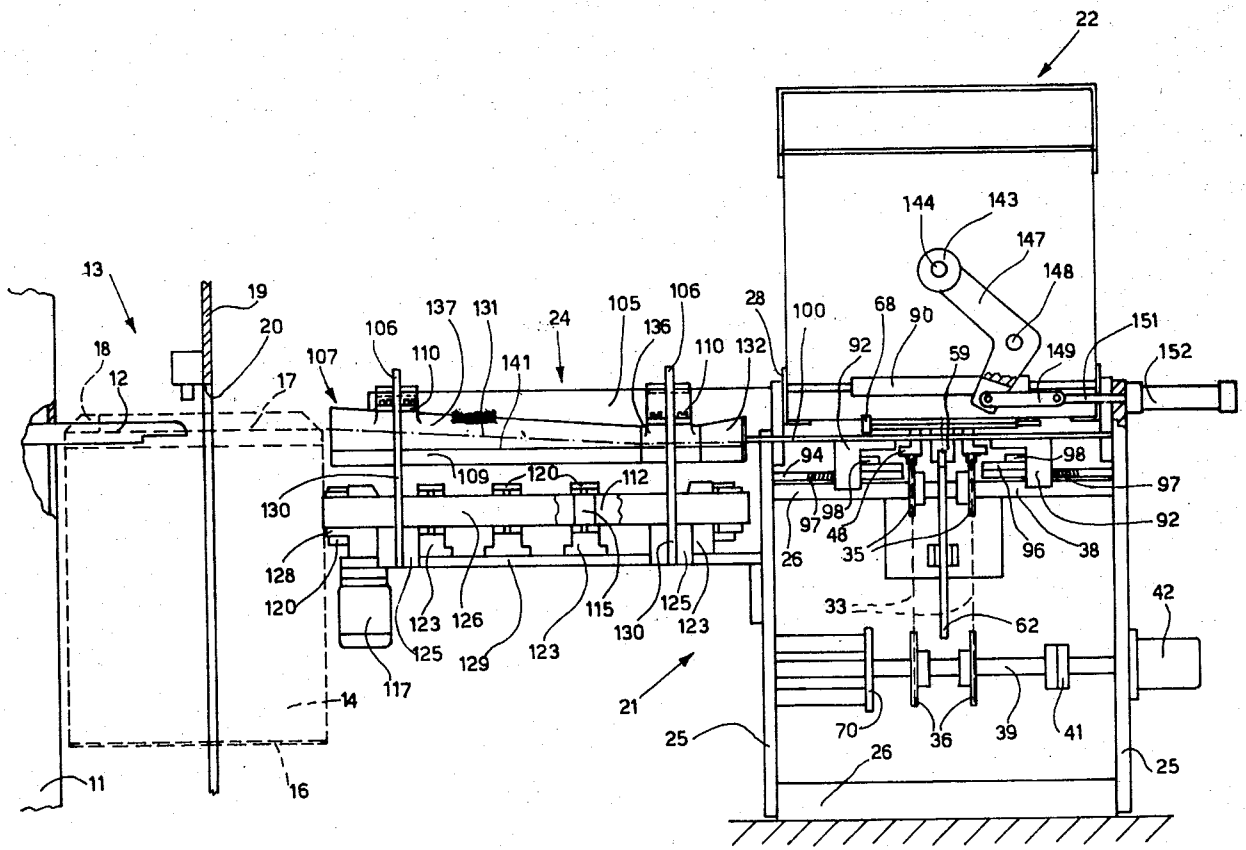
FIG. 3 is a partial lateral view of the machine viewed from the right of FIG. 1.

The cement is automatically packaged from the spout 12 into a bag 14, indicated by broken lines in FIG. 3. The bags 14 are provided on two end edges with two flanges 16 and 17 as bellows, normally folded on one face of the bag 14. The lower flange 16 is closed, while the upper flange 17 is provided with a valve 18, which must be opened to place the bag 14 on the spout 12. Since the cement is sent to the spout 12 under pressure produced by compressed air, when the bag 14 is removed from the spout 12, the pressure of the cement automatically closes the valve 18.

The spouts 12 are mounted on the structure 11 so as to be rocked downwards after having filled a bag 14, to allow the filled bag 14 to be automatically taken off from the spout 12. The structure 11 is surrounded by a shell 19 (FIG. 1) having an aperture 20 on the station 13 to allow the bags 14 to be placed on the spout 12.

The bags 14 are feed to the packaging apparatus by a bag feeding machine, generically indicated by the numeral 21, which includes a magazine 22 containing a pile of bags 14, a bag picking and transfering device 23 and a bag introducing device 24 providing also for opening the valve 18.

BAG PICKING AND TRANSFERRING DEVICE

Figures 2, 4:
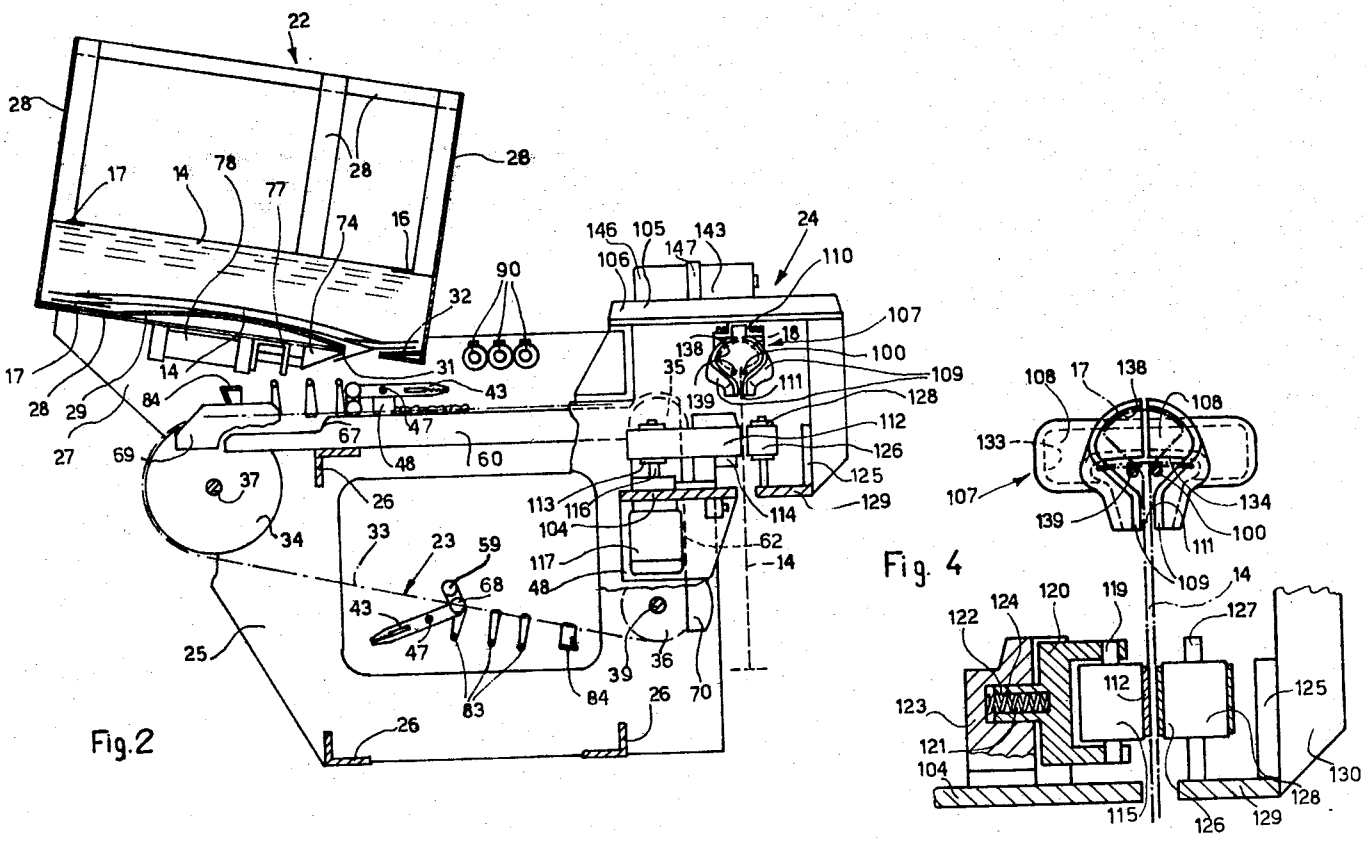
FIG. 2 is partial sectional view taken along the line II—II of FIG. 1.
FIG. 4 is a detail of FIG. 2 in an enlarged scale.

The bag feeding maching 21 comprises a stationary frame formed of a pair of parallel flanks 25 connected by a plurality of transverse bars 26 (FIG. 2). The mazagine 22 is secured to the flanks 25 by means of a pair of plates 27 and is formed by a metallic parallelepiped frame 28, including a bottom plate 29 supporting the bags 14. The plate 29 is slightly arcuate to take into account the thickners of the folded flanges 16 and is slightly inclined rightwards in FIG. 2. The bags 14 are loaded into the magazine 22 with the flanges 16 and 17 directed downwards and the flange 17 having the valve 18 at left. The plate 29 is provided with an aperture 31 and a portion 32 bent with respect to the plate 29 to cause the flange 16 of the bottom bag 14 to rock, as indicated in FIG. 2.

The device 23 comprises a pair of chains 33, each one engaging three toothed pulleys 34, 35 and 36. The corresponding pulleys of the two chains are secured to three shaft 37, 38 and 39 (FIG. 3) rotatable on the flanks 25 of the machine. The shaft 39 is connected through a clutch 41 to an electric motor 42 adapted to rotate the chains 33 (FIG. 2) clockwise.

Two grippers 43 for picking up the bags 14 are mounted equidistant on the two chains 33, whereby at each cycle of the chains 33 two bags 14 can be picked up from the magazine 22. Each gripper 43 is fulcrumed on a pivot 47 carried by a member 18 secured to a link of the two chains 33. Each gripper 43 is held closed by spring means not shown. It is also provided with a roller 59 adapted to cooperate with the profile of two stationary plates 60 and 62 (FIG. 3) located between the two chains 33 and adapted to rock the gripper 43 on the pivot 47 (FIG. 2) against the urge of another spring not shown. Another roller 68 of each gripper 43 is adapted to cooperate with the profile of two other stationary cam plates 69 and 70 for opening the gripper 43 against the spring urge.

Located in correspondence with the two ends of the aperture 31 are two wedges 74 (FIGS. 1 and 2). Each wedge 74 is secured to a fluid actuated piston 75 operable in cylinder 76 in turn secured to a flange of a O-shaped bar 77 of the magazine 22. The piston 75 and a pair of pins 78 also secured to the wedge 74 can slide in corresponding holes of the other flange of the bar 77. The cylinder 76 is adapted to be operated in synchronism with the movement of each gripper 43, in a known manner.

Each gripper 43 is associated with a group of three bars 83 (FIG. 2), each one secured to two corresponding links of the two chains 33. Each gripper 43 is also associated with a wedge 84 secured to other two links of the chains 33. The wedge 84 is directed in a direction opposite to the movement of the chains 33. When the wedge 84 and the associated gripper 43 lie in a rectilinear portion of the chains 33, the sharp edge of the wedge 84 is distanced from the end of the associated gripper 43 less than the distance between the flanges 16 and 17 of the bag 14. The gripper 43, the bars 83 and the wedge 84 are so distanced from the chains 33 that when the bag 14 is partly in the horizontal zone of the chain path and partly in the vertical zone, the flange 17 engages the wedge 84 and is rocked thereby with respect to the bag 14.

Three pressure rollers 90 of elastic material, for example rubber are mounted on vertical slots of the flanks 25 of the machine frame. Each roller 90 is normally held downwards by springs not shown. Two bent members 92 (FIG. 1 and 3) are fulcrumed on two pivots 94 secured to the flanks 25 adjacent the two pulleys 35 of the two chains 33. Secured to each member 92 is an arm 96 (FIG. 1) normally urged by a spring 97 (FIG. 3) to contact a stationary stop member 98. The arm 96 is adapted to be engaged by a chain portion 99 (FIG. 1) laterally connected to each chain 33. A stationary bar 100 parallel to the pivots 94 is located in correspondence with the members 92 to form a guide for the flange 17 of the bags 14.

Upon switching on the motor 42 (FIG. 3), this latter rotates the pulleys 36, thus continuously moving the two chains 33 (FIG. 3) clockwise, together with the grippers 43. Taking into consideration the lower gripper 43, when it arrives at a predetermined position a bag picking up cycle is started. Firstly the two cylinders 76 (FIG. 1) are operated to move the pistons 75 rightwards together with the two wedges 74. These latter engage the flange 16 (FIG. 2) of the lower bag 14, which is thus further rocked. Simultaneously, the roller 68 of the gripper 43 engages the cam plate 69, which causes the opening of the gripper 43. When the wedges 74 reach the end of their rightward stroke, the roller 68 leaves the plate 69, whereby the gripper 43 is suddenly closed and engages the flange 16 of the bag 14. Now the cylinders 76 are operated in opposite direction, whereby the wedges 74 are restored leftwards.

Thereafter, the roller 59 of the gripper 43 engages the cam portion 67 of the plate 62, which rocks the gripper 43 clockwise on the pivot 47, thus extracting the flange 16 of the bag 14 from the magazine 22 and assuming the horizontal position of the upper gripper 43 in FIG. 2. Now the transport of the extracted bag 14 is effected, while the bars 83 and the wedge 84 prevent the bag 14 from contacting the chains 33. In turn the rollers 90 prevent the bag 14 from flutering. Before the gripper 43 reaches the vertical portion of its path, the two lateral chain portions 99 (FIG. 1) engage the arms 96, thus rocking the members 92 as to bring them out of the path of the bags 14. Thereafter, the roller 59 (FIG. 2) of the gripper 43 engages the cam plate 62, whereby the gripper 43 is rocked to the vertical position and inserts the bag 14 between the bar 100 and the members 92 (FIG. 1). Since the radius of the path of the bag 14 is greater than that of the chains 33 (FIG. 2), the bag 14 brings now its flange 17 to engage the wedge 84, whereby the flange 17 is rocked with respect to the bag 14.

The lateral chain portions 99 (FIG. 1) release now the arms 96, whereby the members 92 are brought to a stop positon for the flange 17. Thereafter, the roller 59 (FIG. 2) leaves the plate 62, thus causing the gripper 43 to rock counterclockwise on the pivot 47, while the roller 68 engages the cam plate 70, which causes the gripper 43 to open. The flange 17 of bag 14 is now arrested by the bar 100 and the members 92. Finally, the roller 68 leaves the cam plate 70, whereby the gripper 43 closes again after having disengaged the flange 16. While this gripper 43 leaves the plate 70, the other gripper 43 is ready to extract the next following bag 14, whereby the transport cycles are effected sequentially.

BAG INTRODUCING DEVICE

According to a first embodiment of the invention, the bag introducing device 24 is supported by a plate 104 and a C-shaped bar 105, both secured to one of the flanks 25 of the machine. Secured to the bar 105 are two transverse members 106 (FIG. 3) having a reverse T-shaped section and mounting a shaping tube 107 for the flange 17 of the bag 14, which is adapted to open the valve 18 of the bag 14. Particularly, the shaping tube 107 is formed of two parts 108 (FIG. 4) mutually symmetric in respect to a vertical plane. The two parts 108 terminate downwards with two bent edges 109 defining an axial notch 111 for the passage of the body of the bag 14. Secured to each transverse member 106 (FIG. 3) is a bracket 110, on which the two parts 108 can be individually secured at an adjustable mutual distance between certain limits, in order to adequate the tube 107 to the width of the flange 17 of the bag 14. In fact the width of the flange 17 may vary between certain limits according to the sizes of the bags 14, which follow specific standards and may also vary according to the material to be filled in.

The shaping tube 107 is distanced from the spout 12 as to allow the bag 14 inserted on the spout 12 to be filled and removed from the spout 12 without displacing the tube 107. Since, as it has been mentioned hereinabove, the spout 12 is rocked downwards when the bag 14 is full, to allow the removel of the filled bag the distance between the left end of the tube 107 and the structure 11 must be at least slightly greater than the width of the bag 14. This latter requires to be hurled from the tube 107 to the spout 12 for being inserted therein.

For moving the flange 17 of the bag 14 through the shaping tube 107, the bag 14 is hurled at high speed by continuously moving means engaging the bag 14 below the notch 111 of the tube 107. Said moving means include a driving belt 112 (FIG. 1) wound on a driving pulley 113 and a set of idle pulleys 114 and 115. The pulley 113 is secured to a shaft 116 of an electric motor 117 (FIG. 2) secured to the plate 104. The pulleys 114 are rotatable on corresponding shafts 118 secured to the plate 104, whereas the pulleys 115 are rotatable on corresponding shafts 119 (FIG. 4) each one secured to a fork 120. This latter is provided with a prismatic projection 121, which is slidable into a horizontal guide 122 provided on a support member 123 secured to the plate 104. A compression spring 124 urges the fork 120 rightwards in FIG. 4, to tension the belt 112 and to urge same toward the bag 14.

The path of the belt 112 (FIG. 1) includes a rectilinear portion comprised between one of the pulleys 114 and one of the pulleys 115 and having a length substantially equal to the length of the shaping tube 107. This rectilinear portion is vertically aligned with the notch 111 (FIG. 4) of the tube 107 and cooperates with a driven belt 126 (FIG. 1) wounded on a set of idle pulleys 128 rotatable on vertical shafts 127. These latter are mounted on a plate 129 having a pair of lugs 125 secured to the transverse members 106 by means of a pair of vertical bars 130. The two end pulleys 128 (FIG. 1) are mounted on the plate 129 by means of forks similar to the forks 120 (FIG. 4) above described for the pulleys 115, in order to tension the belt 126.

The shaping tube 107 is provided with a cross section variable along its axis, which is defined by the series of baricenters of the various cross sections. This axis is indicated by dot and dashes in FIG. 3 and by the numeral reference 131. Particularly, the shaping tube 107 includes a first portion 132 substantially in form of a funnel and having a cross section oblong in the horizontal direction. This portion starts with a section 133 (FIG. 4) of substantially rectangular shape, with rounded angles and with a width much greater than the width of the flange 17 of the bag 14. The portion 132 terminates with a section 131 having the upper edge slightly rounded and a width slightly narrower than the width of the flange 17. Therefore under the urge of the belts 112 and 126 on the bag 14, the flange reaching the section 134 is compelled to be slightly curved, whereby the two wings of the flange 17 are bent downwards.

The portion 133 of the shaping tube 107 is followed by a portion 136 (FIG. 3) having a constant cross section and followed in turn by another portion 137 having again a variable section. The portion 137 starts with the section 134 (FIG. 4) and terminates with a section 138 substantially oblong in the vertical direction. However, the perimetric length of the cross section of the portion 137 remains substantially constant from the section 134 to the section 138.

The shaping tube 107 is crossed through its entire length by the bar 100 and by a second bar 139 (FIG. 1) parallel to the bar 100 and aligned to the corner of the members 92 in the position stopping the flange 17. Secured to the member 92, adjacent the tube 107, is a pin 140, which is provided to reduce to a minimum the discontinuity of the guide of the flange 17 from the members 92 to the bar 139.

The zone of the tube 107 adjacent the notch 111, and particularly, the rectilinear corner 141 formed by each bent edge 109 on the corresponding part 108 of the tube 107, is located at a constant distance from the corresponding bar 100, and 139 respectively. Therefore, the axis 131 (FIG. 3) of the portion 137 of the tube 107 is slightly inclined upwards with respect to the bars 100 and 139. When the flange 17 of the bag 14 is hurled to cross the portion 137 of the tube 107, the wings of the flange 17 bent downwards in the portion 136 (FIG. 4) are compelled to raise. Since the bag 14 is gripped between the belts 112 and 126, the same wings are urged to remain in contact with the bars 100 and 139, whereby the valve 18 is automatically opened with a high reliability, as indicated in FIG. 4 by the dot and dash lines adjacent the section 138.

The bag introducing device 24 (FIG. 1) comprises also a continuously rotating roller 143, which is adapted to cooperate with the bar 100 for advancing the bag 14, arrested by the bar 100 and the member 92, toward the shaping tube 107. The roller 143 is secured to a shaft 144 of an electric motor 146. This latter is secured to one end of an oscillating arm 147 (FIG. 3) fulcrumed on a stationary shaft 148 and connected by means of a rod 149 to a fluid actuated piston 151 operable in cylinder 152 secured to one flank 25 of the machine frame. The cylinder 152 can be actuated as to move the piston 151 either in one direction for rocking the arm 147 counterclockwise, or in the opposite direction for restoring the arm 147 clockwise.

After a predetermined delay with respect to the operation of the cylinders 76 (FIG. 1), the cylinder 152 is actuated as to move the piston 151 (FIG. 3) rightwards. The arm 147 is thus rocked counterclockwise and brings the rotating roller 143 to engage the flange 17 of the bag 14 contacting the bar 100. The roller 143 under the action of the motor 146 (FIG. 1) moves the bag 14, guided by the bars 100 and 139, toward the belts 112 and 126.

The belt 112 moved by the motor 117 (FIG. 3) and cooperating with the belt 126 hurls now the bag 14 at high speed leftwards, thus compelling the flange 17 to cross the shaping tube 107. This latter causes the valve 18 to be opened, while the bag 14 is urged by the belts 112 and 126 to leave the tube 107, till the flange 17 is inserted on the spout 112 of the packaging apparatus, as indicated in FIG. 3. Thereafter, the cylinder 152 is actuated so as to restore the arm 147 to the position of FIG. 3, whereby the bag introducing device 24 completes its cycle.

Figure 5:
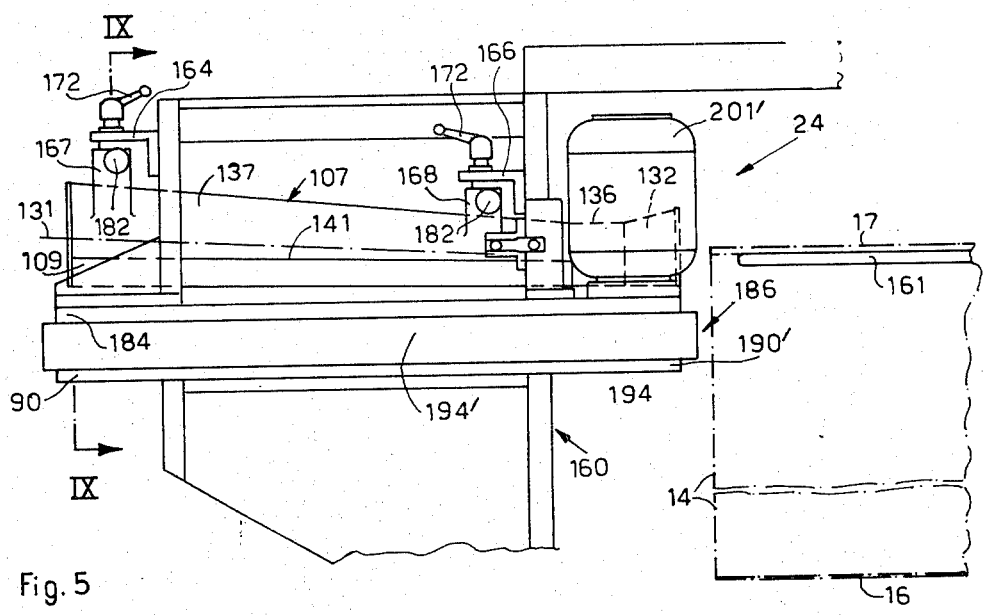
FIG. 5 is a partial lateral view of a bag feeding machine according to another embodiment of the invention.

According to another embodiment of the invention, the bag introducing device 24 includes a stationary frame 160 (FIG. 5) mounting a pair of bar 161 located at the entrance of the shaping tube 107 for guiding and supporting the bag 14. The shaping tube 107 is mounted on a pair of L-shaped supports 164 and 166 secured to the frame 160.

Figure 6:
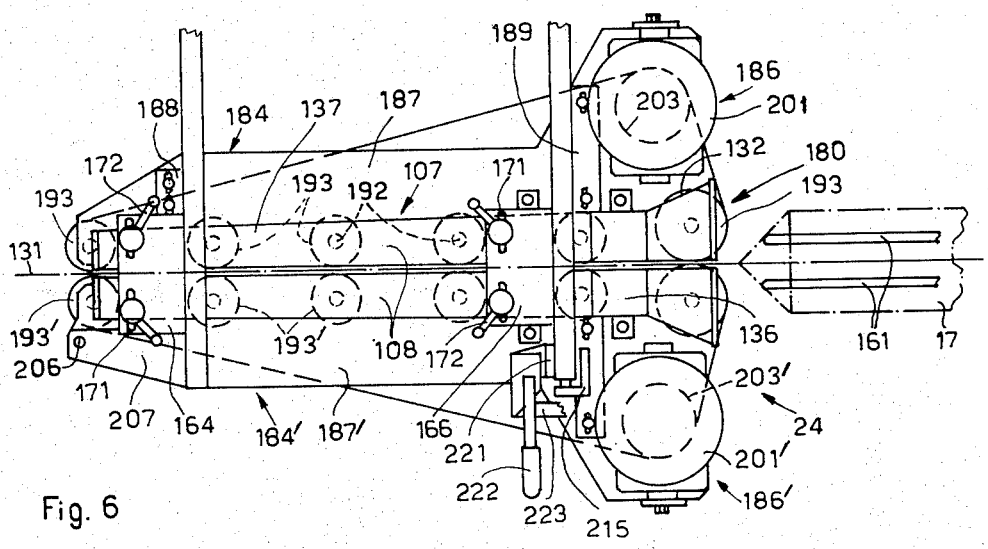
FIG. 6 is a partial plan view of the machine of FIG. 5.

The distance between the two symmetric parts 108 (FIG. 9) of the tube 107 can be easily adjusted to adequate it to the width of the flange 17. To this end each part 108, near its two ends, is provided with two shoulders 167 and 168 (FIG. 5) each one provided with a vertical threaded hole 169 (FIG. 7). A screw 170 is screwed in the hole 169 of each shoulder 167 and 168 and crosses a corresponding oblong slot 171 (FIG. 6) of the corresponding support 164, 166.

Each screw 170 is secured upwards to a manipulative lever 172 bodily rotatable with a washer 173 (FIGS. 7 and 9). A gasket 174 is located between each support 164, 166 and each washer 173. Another gasket 176 is located between the support 164, 166 and the relevant shoulder 167, 168. Upon rocking each lever 172 in one direction, the relevant shoulder 167, 168 is immediately and rigidly locked on the corresponding support 164, 166. By rocking the lever 172 in the opposite direction, the shoulder 167, 168 is unlocked on the support 164, 166.

Each shoulder of each pair 167, 168 (FIGS. 8 and 9) is also provided with a horizontal threaded hole 177, and 178 respectively. The two holes of each pair 177 and 178 are threaded in opposite directions and are engaged by a double screw 179 having two portions threaded also in opposite directions. Each screw 179 is rotatable into a cylindrical hole of a rib 181 of the corresponding support 164, 166 and is secured to a corresponding manipulative knob 182.

Assuming that the two parts 108 are correctly secured at a predetermined distance, to alter the distance between the two parts 108 (FIG. 6) of the tube 107, the four levers 172 are rocked as to unlock them from the supports 164 and 166. Then the two knobs 182 (FIGS. 8 and 9) are rotated in the same direction and simultaneously. The two screws 179 thus cause the pair of shoulders 167 and 168 to move in opposite directions either for increasing or for decreasing their distance, whereby the distance between the two parts 108 is altered, while these letter remain always equally distanced with respect to their plane of symmetry. Therefore, this plane of symmetry, and consequently also the axis 131 (FIG. 5) of the tube 107, remains always centered with repect to the spout 12 (FIG. 1). Of course, in the case the two parts 108 are initially incorrectly secured on the supports 164 and 166 (FIG. 6), for instance because they are converging or diverging, the two knobs 182 must be rotated individually. In any case after having adjusted the distance between the parts 108, they are again locked on the supports 164, 166 by accordingly rocking the levers 172.

Secured to the machine frame 160 is a bracket 184 (FIG. 6) including an upper plate 187 adjustably mounted on a pair of supports 188 and 189 of the machine frame 160, and a lower plate 190 (FIG. 9) secured to the upper plate 187 by means of a set of transverse plates 191. The bracket 184 carries continuously moving means, generically indicated by 186 (FIG. 6), for hurling the bag 14 toward the spout 12. The moving means 186 comprise a set of pivots 192 (FIG. 6) secured to the plates 187 and 190. Each pivot 192 rotatably mounts, by means of a rolling bearing, a corresponding toothed pulley 193 (FIG. 9) cooperating with a driving toothed belt 194. The plate 187 is provided with a notch 196 (FIGS. 8 and 9) for adjustably mounting a plate 197, by means of a pair of screws 199 screwed on a pair of brackets 198. The external screw 199 engages also a ring 200 integral with another screw engaging a transverse bracket 210, whereby by screwing on this latter screw the corresponding bolt, the position of the plate 197 can be adjusted.

Secured to the plate 197 is the stator of an electric motor 201 having a shaft 202 secured to the hub of a toothed driving pulley 203 also engaged by the belt 194. By adjusting the position of the plate 197 on the notch 196, the tension of the driving belt 194 can be accordingly adjusted. The adjustable mounting of the plate 187 on the supports 188 and 189, allows the adjusting of the position of the belt 194 with respect to the symmetry plane of the shaping tube 107, according to the thickness of the bag 14.

The machine is also provided with a second bracket 184' (FIG. 6), substantially symmetric to the bracket 184, whereby the corresponding parts of the bracket 184' are indicated with the primed numeral references of the parts of bracket 184. Therefore, the bracket 184' carries a second set of toothed pulleys 193', a second electric motor 201', the shaft 202' of which (FIG. 7) is secured to a driving pulley 203', and a belt 194' engaging the pulleys 193' and 203', whereby the path of the belt 194' is symmetric to that of the belt 194. It is thus evident that both belts 194 and 194' drive the bag 14 into the shaping tube 107.

Contrary to the bracket 184, the plate 187' of the bracket 184' is provided with a bushing 204 (FIG. 9) rotatably mounted on a pivot 206 secured to a support 207 (FIG. 6) integral with the machine frame 106. Particularly, the pivot 206 comprises a threaded portion screwed into a hole of the support 207 and a head 208 (FIG. 9) for retaining the plate 187'. Furthermore, the plate 187' is provided with at least a slot 209 (FIG. 8) adapted to slide on a corresponding pin 211 provided with a head, which is directed downwards and is secured on a shoulder 211 (FIG. 9) provided on the frame 160.

Finally, adjustably secured to the plate 187' is a plate 214 integral with a L-shaped member 215 (FIG. 8). This latter is provided with a hole 216 adapted to engage an indexing pin 217 (FIG. 9) secured to another shoulder 218 of the frame 160. The member 215 carries a pair of stop screws 219 located one upwards and the other downwards with respect to the hole 216. The screws 219 are adapted to stop against the shoulder 218. The screws 219 allow the adjustment of the position of the belt 194' with respect to the plane of symmetry of the shaping tube 107.

A support 221 (FIG. 8) secured to the frame 160 mounts a toggle locking device known per se, which comprises a manually operable lever 222, a locking lever 223 and a rod 224 connecting the levers 222 and 223. In the position of FIG. 8, the rod 224 is behind the dead point and, through a lug 225, holds the lever 223 locked against the member 215, whereby it is impossible to unlock the bracket 184' without manually operating the lever 222.

Finally, secured to each of the two plates 187 and 187' are two blocks 226, to which two stems 228 are secured. The stems 228 extend through two corresponding large holes 229 (FIG. 9) provided on the corresponding part 108 of the tube 107. The two stems 228 are also secured to a substantially horizontal corresponding bar 231 for supporting the flange 17 of the bag 14. The bars 231 comprise each one an arquate portion 232 (FIG. 8) and are adapted to facilitate the opening of the valve 18, in a manner similar to the one described for the bars 100 and 139 of FIGS. 1–4.

In the case it is necessary to enter the space between the belts 194, 194' (FIG. 8), for example for replacing one of the belts, the lever 222 is manually rocked clockwise, thus removing the lever 223 from the member 215. Thereafter the bracket 184' is manually rocked around the pivot 206 (FIG. 6) between the limits allowed by the slot 209 (FIG. 8). Even if the part 108 of the tube 107 corresponding to the bracket 184' remains stationary, the holes 229 (FIG. 9) are enough large to allow the displacement of the stems 228 together with the bracket 184'.

The operator can now enter the space between the pulleys 193, 203 and 193', 203' and remove downwards the belt 194 or 194' to be replaced. After having replaced the belt, the bracket 184' is returned to engage the hole 216 on the indexing pin 217 and is locked in this position by returning the lever 222 to the position of FIG. 8. Obviously, the displacement of the bracket 184' may be used for other operations of maintenance or for unlocking accidental situations, for example for removing a bag 14 incorrectly entangled into the tube 107.

It should be evident that many modifications, improvements and additions of parts may be made to the described bag feeding machine, without departing from the scope of the invention. For example, the described feeding machine 21 may be used for a packaging apparatus having one or more spouts in fixed positions. If only one spout 12 is provided, the feeding machine 21 will be located in a fixed position, with the shaping tube 107 aligned with the spout 12. On the contrary, if the packaging apparatus is provided with more than one spouts 12, the feeding machine 21 may be mounted on a carriage, which can be moved according to a predetermined program or cycle to bring sequentially the shaping tube 107 in front of the various spouts.

What I claim is:

1. In a packaging apparatus for powder material having at least one filling spout, a valve bag feeding machine for picking up the bags one at a time from a magazine and placing same on said filling spout, comprising:

a shaping tube having an internal curved surface and a section continuously variable throughout its length for causing the valve flange of a bag crossing said tube to be shaped as to open said valve, a downwards directed notch on said tube for the passage of the bag body, said tube having a substantially horizontal axis aligned with said spout and being distanced from said spout as to allow the bag to be filled and removed from the spout without displacing the tube, means for bringing one bag at a time to the entrance of said tube, and belt means continuously moved for engaging the body of the bag, so brought at said entrance, below said notch substantially along the entire length of said tube, said belt means hurling the engaged bag at high speed as to cause the valve flange to cross said tube and to assure its placing on said spout substantially when said valve flange leaves said tube, due solely to the hurling action of said belt means.

2. In a packaging apparatus for powder material having at least one filling spout, a valve bag feeding machine for picking up the bags one at a time from a magazine and placing same on said filling spout, comprising:

a shaping tube having a variable section for shaping the valve flange of a bag crossing said tube as to open said valve, a downwards directed notch on said tube for the passage of the bag body, said tube having a substantially horizontal axis aligned with said spout and being distanced from said spout as to allow the bag to be filled and removed from the spout without displacing the tube, hurling means for hurling the bag at high speed as to cause the valve flange to cross said tube and to assure its placing on said spout substantially when said valve flange leaves said tube, and a pair of bars for supporting and guiding said valve flanges when crossing said tube, said pair of bars being located inside said tube substantially parallel to the axis of said tube.

3. A machine according to claim 2, wherein said tube comprises at least two different portions arranged sequentially along its axis, a first one of said portions having an oblong section and being funnel shaped for slightly bending downwards the wings of the valve flange, a second one of said portions having a section variable along said axis as to become oblong in a direction perpendicular to said valve flange, a zone of said second portion adjacent said notch having a substantially constant distance from said bars for helping the opening of said valve.

4. A machine according to claim 3, wherein the perimetric length of the section of said second portion is substantially constant along the axis thereof.

5. A machine according to claim 3 wherein said tube is formed of two parts symmetric with respect to the vertical plane where said notch lies, said parts being mounted adjustably according to the width of said valve flange.

6. A machine according to claim 5, wherein said parts are connected to the machine frame by at least one double screw having at its two ends two opposite threads, each one engaging an associated threaded hole provided on the corresponding one of said parts.

7. A machine according to claim 1, wherein said belt means comprising a driving belt moved by driving pulleys along a closed path and cooperating with a driven belt along substantially the entire length of said tube urging means being provided for urging said belts one toward the other.

8. A machine according to claim 1, wherein said belt means comprises a pair of driving belts each one moved by a corresponding driving pulley and being guided along a closed path, said belts contacting each other substantially along the entire length of said tube, said driving pulleys being each one driven by a corresponding electric motor, the paths of said two belts being symmetric with respect to the axis of said tube.

9. A machine according to claim 8, wherein one of said belts is carried by a plate normally located in an effective position, mounting means being provided for mounting said plate on the machine frame so as to be displaced on its plane to take away the relevant belt from the other belt, a locking device being provided for positively locking said plate in said effective position.

10. A machine according to claim 9, wherein said mounting means include a pivot located near one end of said tube, the motor driving the belt of said plate being located near the other end of said tube.

11. A machine according to claim 8, wherein at least one of said motors is adjustably mounted on the machine frame for tensioning the relevant belt.

12. Method for placing a bag having a valve flange on a spout of a powder material packaging apparatus, characterized by the step of picking up the bags one at a time from a magazine, the step of bringing the picked up bag to the entrance of a stationary shaping tube having a substantially horizontal axis aligned with said spout, the step of causing the valve flange of said bag to cross said tube, said tube having an internal curved surface and a section continuously variable through its length as to cause said valve to be opened, and by the step of hurling said bag when crossing said tube at such high speed as to assure that said valve be placed on the spout substantially when said valve flange has left said tube due solely to said hurling action.

13. In a packaging apparatus for powder material having at least one filling spout, a valve bag feeding machine for picking up the bags one at a time from a magazine and placing same on said filling spout, each bag having at one edge a fold flange forming two wings and a valve which can be opened by pushing the two wings one toward the other, comprising:

a shaping tube having a section continuously variable throughout its length for causing the valve flange of a bag crossing said tube to be shaped by pushing the two wings of the flange one toward the other as to open said valve, said tube being so distanced from said spout as to allow the bag to be filled and removed from the spout without displacing the tube, a downwards directed notch on said tube for the passage of the bag body, said tube having a substantially horizontal axis aligned with said spout, means for bringing one bag at a time to the entrance of said tube, and at least a pair of belts permanently in mutual contact and continuously movable for engaging the body of the bag so brought at said entrance, below said notch substantially along the entire length of said tube, for causing the valve flange to cross said tube and to assure its placing on said spout.

14. Method for placing on a spout of a powder material packaging apparatus, a bag having at one edge of fold flange forming two wings and a valve which can be opened by pushing the two wings one toward the other, characterized by the step of picking up the bags one at a time from a magazine, the step of bringing the picked up bag to the entrance of a stationary shaping tube having a substantially horizontal axis aligned with said spout, the step of causing the valve flange of said bag to cross said tube, said tube having a section continuously variable through its length as to push the two wings of the flange one towards the other to cause said valve to be opened, and by the step of hurling said bag when crossing said tube at such a speed as to assure that said valve be placed on the spout substantially when said valve flange has left said tube.

15. A valve bag opening device for bags having at one edge a fold flange forming two wings and a valve adapted to be opened, said device comprising:

a pair of shaping members symmetric with respect to a vertical plane and having a continuously variable cross section throughout their length, said members being so bent as to form a tube with a downwardly directed notch, a pair of belts having a portion permanently in mutual contact on said vertical plane along the entire length of said tube, and moving means for continuously moving said belts for engaging the body of a bag to cause its valve flange to pass inside said tube, said members including a first zone at the entrance side for said bag forming a passage larger than said valve flange, a second subsequent zone where said passage becomes narrower than said valve flange as to push said wings one toward the other to cause said valve flange to be curved, said first and second zones having an axis substantially parallel to said portion of the belts, said members including a third zone having an axis forming with the axis of said first and second zones an angle opposite to the body of the bag with respect to the valve flange to cause said flange to be displaced with respect to the bag body so as to open said valve.

16. A device according to claim 15, including a pair of supporting elements for supporting and guiding said valve flange when crossing at least said first zone of the tube.

* * * * *

UNITED STATES PATENT AND TRADEMARK OFFICE

CERTIFICATE OF CORRECTION

PATENT NO. : 4,231,212

DATED : November 4, 1980

INVENTOR(S) : Angelo Raiteri

It is certified that error appears in the above-identified patent and that said Letters Patent is hereby corrected as shown below:

On the Title Page insert:

--- [30] Foreign Application Priority Data

| | | | |
|---|---|---|---|
| Italy | [IT] | 69309-A/76 | 09/28/76 |
| Italy | [IT] | 68542-A/77 | 07/04/77 ---. |

Signed and Sealed this

*Twenty-third* Day of *August 1983*

[SEAL]

*Attest:*

GERALD J. MOSSINGHOFF

*Attesting Officer*

*Commissioner of Patents and Trademarks*